US008321989B1

(12) United States Patent
McClanahan

(10) Patent No.: US 8,321,989 B1
(45) Date of Patent: Dec. 4, 2012

(54) SCRAPING TOOL SYSTEMS

(76) Inventor: Michael G. McClanahan, Glendale, AZ (US)

( * ) Notice: Subject to any disclaimer, the term of this patent is extended or adjusted under 35 U.S.C. 154(b) by 1184 days.

(21) Appl. No.: 11/425,982

(22) Filed: Jun. 22, 2006

Related U.S. Application Data

(60) Provisional application No. 60/693,197, filed on Jun. 23, 2005.

(51) Int. Cl.
*A47L 23/22* (2006.01)

(52) U.S. Cl. ..... 15/236.07; 15/236.01; 15/236.03

(58) Field of Classification Search ..... 15/236.01, 15/236.03, 236.07
See application file for complete search history.

(56) References Cited

U.S. PATENT DOCUMENTS

| | | | | | |
|---|---|---|---|---|---|
| 1,325,540 | A | * | 12/1919 | Spahr | 30/169 |
| 1,704,329 | A | * | 3/1929 | Klaus | 15/236.07 |
| 4,324,018 | A | * | 4/1982 | Olsson | 15/236.03 |
| 4,355,432 | A | * | 10/1982 | Storm, Jr. | 15/245 |
| 4,627,128 | A | | 12/1986 | Shea | |
| 4,987,635 | A | * | 1/1991 | Young | 15/236.01 |
| 5,272,786 | A | * | 12/1993 | Edstrom | 15/236.07 |
| 5,624,145 | A | | 4/1997 | Swilley | |
| 5,799,997 | A | * | 9/1998 | Lehn et al. | 294/55 |
| D405,661 | S | | 2/1999 | Erickson | |
| 6,012,227 | A | | 1/2000 | Lent | |
| 7,073,935 | B2 | * | 7/2006 | Liem | 366/129 |

* cited by examiner

*Primary Examiner* — Joseph J Hail
*Assistant Examiner* — Shantese McDonald
(74) *Attorney, Agent, or Firm* — Stoneman Law Patent Group; Martin L. Stoneman; Kyle Liudahl

(57) ABSTRACT

A scraping tool for removing material from a bucket. The scraping tool has a blade which conforms to the curved sidewall of a bucket and is substantially flat so it can be inexpensively manufactured and efficiently stacked for shipping and storage.

2 Claims, 4 Drawing Sheets

SCRAPING TOOL SYSTEMS

CROSS-REFERENCE TO RELATED APPLICATION

The present application is related to and claims priority from prior provisional application Ser. No. 60/693,197, filed Jun. 23, 2005, entitled "SCRAPING TOOL SYSTEMS", the contents of which are incorporated herein by this reference and are not admitted to be prior art with respect to the present invention by the mention in this cross-reference section.

BACKGROUND

This invention relates to providing a system for improved removal of material from buckets. More particularly this invention relates to providing a system for removing material from a bucket using a specially configured scraping tool.

Removing portions of material (such as, for example, grout), especially the final portions, from a cylindrical bucket using a rectilinear trowel is problematic since, among other problems, material escapes between the curved sidewalls of the bucket and the rectilinear edge of the trowel. No simple, inexpensive tool exists to easily and efficiently remove the final portions of material from buckets.

OBJECTS AND FEATURES OF THE INVENTION

A primary object and feature of the present invention is to provide a scraping tool system which solves the above-mentioned problems.

It is a further object and feature of the present invention to provide such a scraping tool system with a blade that conforms to the curved sidewall of a bucket.

It is a further object and feature of the present invention to provide such a scraping tool system that can be inexpensively manufactured. It is a further object and feature of the present invention to provide such a scraping tool system that can be stacked for efficient shipping and storage.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a scraping tool system, relating to scraping material from at least one container having at least one substantially round cylindrical internal sidewall, comprising: substantially flat gripping means for gripping such scraping tool system at at least one substantially flat portion of such scraping tool system; and substantially flat scraping means for scraping the material from the at least one substantially round cylindrical internal sidewall with at least one substantially flat edge portion of such scraping tool system; wherein such substantially flat scraping means comprises conforming means for conforming to the at least one substantially round cylindrical internal sidewall; wherein such conforming means comprises at least one substantially round arc; wherein such substantially flat scraping means is substantially coplanar with such substantially flat gripping means. Moreover, it provides such a scraping tool system wherein such scraping tool system consists essentially of one monolithic piece. Additionally, it provides such a scraping tool system wherein such at least one substantially round arc comprises at least one first radial distance about equal to at least one radial distance of the at least one substantially round cylindrical internal sidewall. Also, it provides such a scraping tool system wherein such at least one first radial distance is substantially four inches. In addition, it provides such a scraping tool system wherein such gripping means comprises hanging means for hanging such scraping tool system. And, it provides such a scraping tool system wherein such hanging means comprises at least one aperture.

In accordance with another preferred embodiment hereof, this invention provides a scraping tool system, relating to scraping material from at least one substantially round cylindrical bucket having at least one sidewall, comprising: at least one substantially flat handle; and at least one substantially flat scraper structured and arranged to scrape the material from inside the at least one substantially round cylindrical bucket; wherein such at least one substantially flat scraper comprises at least one blade structured and arranged to conform to at least one sidewall; wherein such at least one blade comprises at least one substantially arcuate edge; wherein such scraping tool system consists essentially of one monolithically cast piece. Further, it provides such a scraping tool system wherein such scraping tool system is substantially flat. Even further, it provides such a scraping tool system wherein such at least one substantially flat scraper is substantially coplanar with such at least one substantially flat handle. Moreover, it provides such a scraping tool system wherein such at least one substantially flat scraper is substantially perpendicular to such at least one substantially flat handle. Additionally, it provides such a scraping tool system wherein such at least one substantially arcuate edge comprises at least one first radius; and such at least one first radius is substantially four inches. Also, it provides such a scraping tool system wherein such handle comprises at least one hanger. In addition, it provides such a scraping tool system wherein such hanger comprises at least one aperture. And, it provides such a scraping tool system wherein such scraping tool system consists essentially of plastic. Further, it provides such a scraping tool system wherein such at least one substantially arcuate edge comprises at least one first radius; and such at least one first radius is substantially four inches; such scraping tool system consists essentially of plastic. Even further, it provides such a scraping tool system wherein such at least one substantially flat scraper is substantially coplanar with such at least one substantially flat handle. Moreover, it provides such a scraping tool system wherein such at least one substantially flat scraper is substantially perpendicular to such at least one substantially flat handle. Additionally, it provides such a scraping tool system wherein such at least one substantially flat scraper has a blade width of about 6½ inches. Also, it provides such a scraping tool system wherein such at least one substantially flat scraper has a blade length of about 1½ inches. In addition, it provides such a scraping tool system wherein such scraping tool system is structured and arranged to be stackable.

In accordance with another preferred embodiment hereof, this invention provides a scraping tool system, relating to scraping material from at least one substantially round cylindrical bucket having at least one sidewall, comprising: at least one handle; and at least one scraper structured and arranged to scrape the material from inside the at least one substantially round cylindrical bucket; wherein such at least one scraper comprises at least one blade structured and arranged to conform to at least one sidewall; wherein such at least one blade comprises at least one substantially arcuate edge; wherein such scraping tool system consists essentially of one monolithically cast piece; wherein such scraping tool comprises at least one neck connecting such at least one handle to such at least one scraper. And, it provides such a scraping tool system wherein such at least one neck comprises at least one neck reinforcer; and such at least one neck reinforcer comprises at least one ridge of material.

In accordance with another preferred embodiment hereof, this invention provides a scraping tool system, relating to scraping material from at least one container having at least one substantially round cylindrical internal sidewall, comprising: at least one substantially flat gripper adapted to assist gripping such scraping tool system at at least one substantially flat portion of such scraping tool system; and at least one substantially flat scraper adapted to scrape the material from the at least one substantially round cylindrical internal sidewall with at least one substantially flat edge portion of such scraping tool system; wherein such at least one substantially flat scraper comprises at least one substantially round arc; wherein such at least one substantially flat scraper is substantially coplanar with such at least one substantially flat gripper. Further, it provides such a scraping tool system wherein such scraping tool system consists essentially of one monolithic piece.

DETAILED DESCRIPTION OF THE BEST MODES AND PREFERRED EMBODIMENTS OF THE INVENTION

Figure 1:
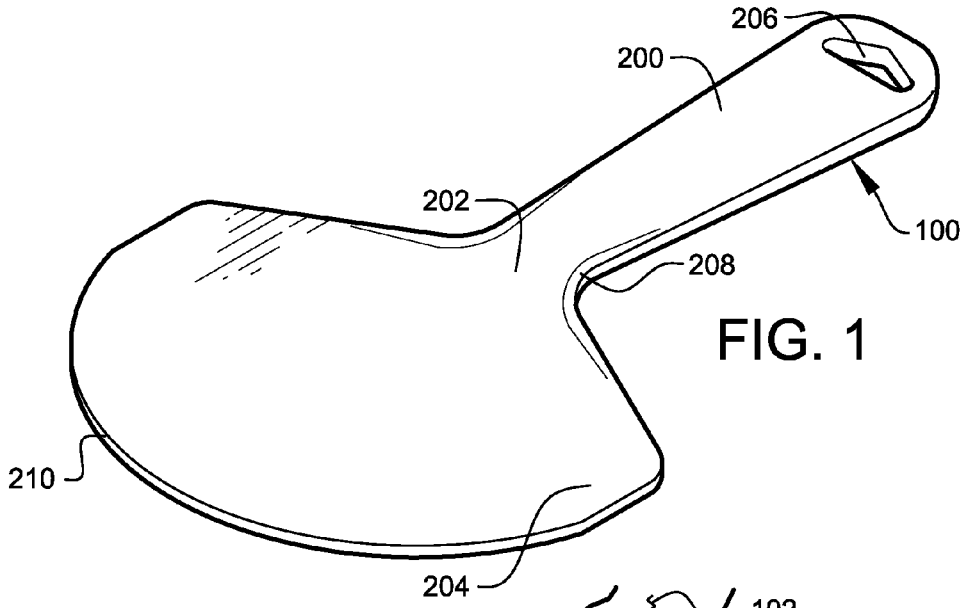
FIG. 1 shows a perspective view of a scraping tool system according to a preferred embodiment of the present invention.

FIG. 1 shows a perspective view of scraping tool system 100 according to a preferred embodiment of the present invention. Preferably, scraping tool system 100 comprises handle 200, neck 202, and blade 204, as shown. Preferably, scraping tool system 100 is one monolithic piece, as shown (at least embodying herein wherein such scraping tool system consists essentially of one monolithic piece). Preferably, scraping tool system 100 is plastic. Upon reading the teachings of this specification, those with ordinary skill in the art will now understand that, under appropriate circumstances, considering such issues as user preference, cost of manufacture, etc., other manufacturing methods and material arrangements, such as, for example, using materials other than plastic (such as, for example, metal, wood, carbon-fiber, using multiple different materials, etc.), punching or cutting the tool from a sheet, assembling pieces rather than casting entire scraping tool system as one monolithic piece, etc., may suffice.

Preferably, handle 200 is substantially flat, as shown (at least embodying herein substantially flat gripping means for gripping such scraping tool system at at least one substantially flat portion of such scraping tool system).

Preferably, blade 204 is substantially flat, as shown (at least embodying herein substantially flat scraping means for scraping material). Preferably, blade 204 comprises blade edge 210, as shown. Upon reading the teachings of this specification, those with ordinary skill in the art will now understand that, under appropriate circumstances, considering such issues as user preference, cost of manufacture, then materials available, etc., other blade arrangements, such as, for example, blades with different shapes, blade edges lined with different material (such as, for example, resilient material, for example, rubber, etc.), etc., may suffice.

Preferably, neck 202 comprises at least one neck reinforcer 208, as shown. Preferably, neck reinforcer 208 strengthens and reinforces neck 202 to help resist bending and breaking. Preferably, neck reinforcer 208 comprises extra material thickness, preferably at least one ridge of extra thick material, as shown. Upon reading the teachings of this specification, those with ordinary skill in the art will now understand that, under appropriate circumstances, considering such issues as user preference, cost of manufacture, then materials available, etc., other neck arrangements, such as, for example, neck reinforcers comprising different materials (such as, for example, metal, etc.), neck reinforcer comprising thickening the entire neck cross-sectional thickness in addition to, or instead of, thickened ridges, etc., may suffice.

Preferably, handle 200 comprises hanger 206, as shown. Preferably hanger 206 is located in handle 200, as shown (at least embodying herein wherein such gripping means comprises hanging means for hanging the scraping tool system). Preferably hanger 206 comprises an aperture, as shown, which is preferably adapted to permit scraping tool system 100 to be hung from a nail (at least embodying herein wherein such hanging means comprises at least one aperture). Upon reading the teachings of this specification, those with ordinary skill in the art will now understand that, under appropriate circumstances, considering such issues as user preference, cost of manufacture, then materials and techniques available, etc., other hanger arrangements, such as, for example, hooks, loops, etc., may suffice.

Figure 2:
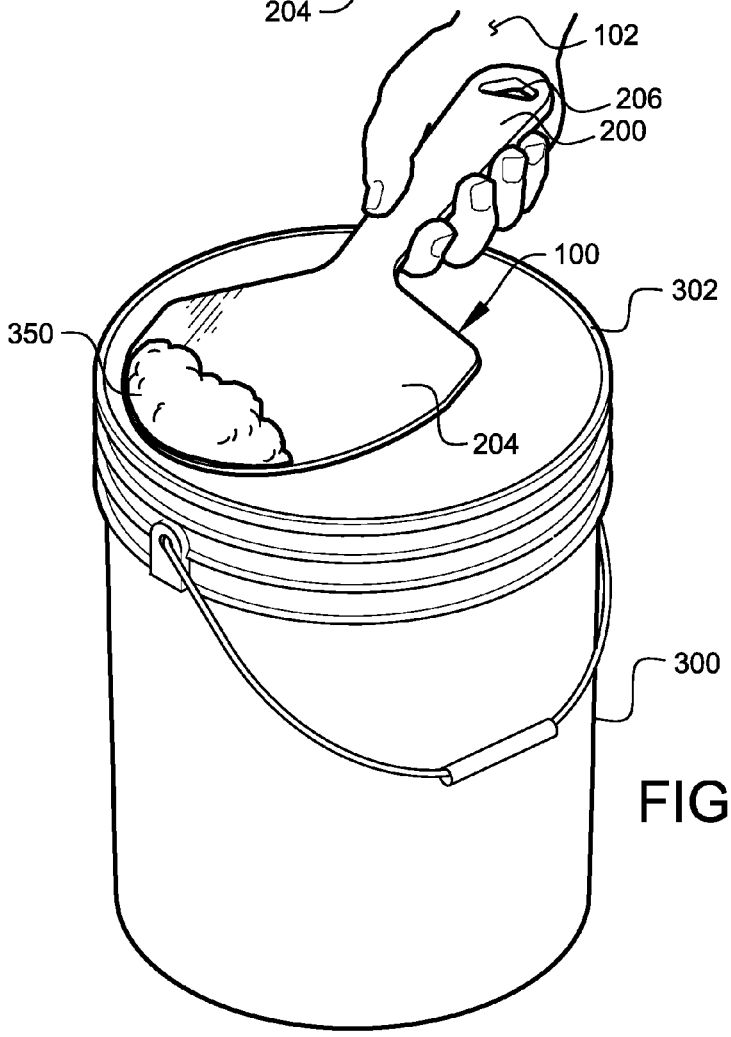
FIG. 2 shows a perspective view of the scraping tool system of FIG. 1 being used to remove material from a bucket.

FIG. 2 shows a perspective view of user 102 using scraping tool system 100 to remove material 350 from bucket 300. Preferably, user 102 grips handle 200 and scrapes blade 204 (at least embodying herein substantially flat scraping means for scraping material from inside the at least one container having at least one substantially round cylindrical internal sidewall) along sidewall of bucket 300 to remove material 350, as shown. Upon reading the teachings of this specification, those with ordinary skill in the art will now understand that, under appropriate circumstances, considering such issues as user preference, etc., providing for use of scraping tool system with containers other than a bucket, such as, for example, other substantially round cylindrical containers, such as, for example, cans, pots, etc., may suffice.

Figure 3:
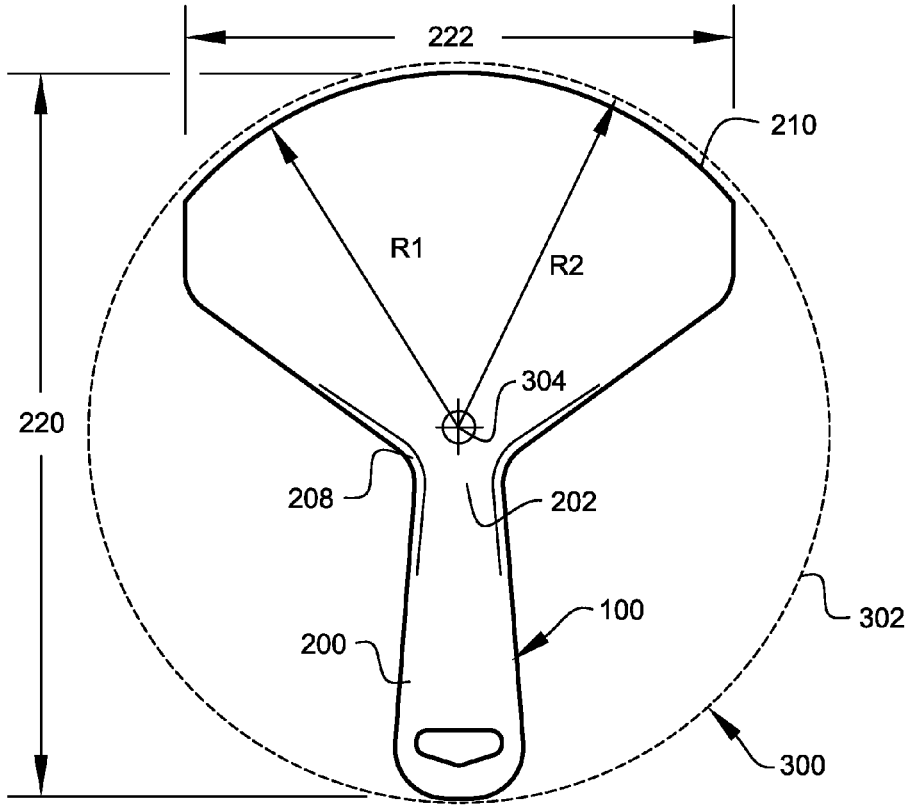
FIG. 3 shows a top plan view of the scraping tool system of FIG. 1, illustrating how the scraping tool system conforms to the bucket sidewall.

FIG. 3 shows a top plan view of scraping tool system 100. Preferably, blade edge 210 conforms to bucket sidewall perimeter 302 of bucket 300, as shown (at least embodying herein wherein such substantially flat scraping means comprises conforming means for conforming to the at least one substantially round cylindrical internal sidewall). Preferably, blade edge 210 has a substantially round arcuate shape, as shown (at least embodying herein wherein such conforming means comprises at least one substantially round arc). Preferably, blade edge 210 has a blade edge radius R1 which is about equal to bucket radius R2 (that is measured from bucket center 304 to bucket sidewall perimeter 302), as shown (at least embodying herein wherein such at least one substantially round arc comprises at least one first radial distance about equal to at least one radial distance of the at least one substantially round cylindrical internal sidewall).

Following are preferred dimensions for a preferred embodiment of scraping tool system 100 for use in conjunction with a bucket 300 having a bucket radius R2 of about four inches (such as, for example, a standard two-gallon bucket). Preferably scraping tool system 100 has a blade edge radius R1, as shown, of about four inches (at least embodying herein wherein such at least one first radial distance is substantially four inches). Preferably scraping tool system 100 has a blade width 222, as shown, of about 6½ inches. Preferably, scraping tool system 100 has a tool length 220, as shown, of about eight inches. Preferably, scraping tool system 100 fits inside and can be laid flat on the bottom of bucket 300, as shown.

Following are preferred dimensions for a preferred embodiment of scraping tool system 100 for use in conjunction with a bucket 300 having a bucket radius R2 of about five inches (such as, for example, a standard five-gallon bucket). Preferably scraping tool system 100 has a blade edge radius R1, as shown, of about five inches (at least embodying herein wherein such at least one first radial distance is substantially five inches). Preferably scraping tool system 100 has a blade width 222, as shown, of about 7½ inches. Preferably, scraping tool system 100 has a tool length 220, as shown, of about nine inches. Upon reading the teachings of this specification, those with ordinary skill in the art will now understand that, under appropriate circumstances, considering such issues as user preference, cost of manufacture, then materials available, etc., other dimensional arrangements, such as, for example larger or smaller dimensions, different radii (such as, 3 inches, 6 inches, etc.), larger or smaller blade widths, etc., may suffice.

Figure 4:
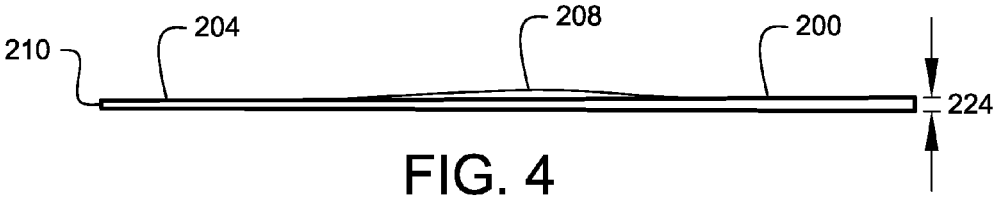
FIG. 4 shows a side elevational view of the scraping tool system of FIG. 1.

FIG. 4 shows a side elevational view of the scraping tool system of FIG. 1. Preferably, scraping tool system 100 has a tool thickness 220, as shown, of about ¼ inch. Preferably, tool thickness 220 of scraping tool system 100 tapers slightly from handle 200 to blade edge 210, as shown. Preferably, scraping tool system 100 is substantially flat, as shown, which allows stacking (see FIG. 4*a*) multiple scraping tool systems 100 for transport and storage (at least embodying herein wherein said scraping tool system is structured and arranged to be stackable). Preferably, handle 200 and blade 204 are substantially coplanar, as shown (at least embodying herein wherein such substantially flat scraping means is substantially coplanar with such substantially flat gripping means). Preferably, tool thickness 220 of scraping tool system 100 is no greater than ½ inch. Upon reading the teachings of this specification, those with ordinary skill in the art will now understand that, under appropriate circumstances, considering such issues as user preference, cost of manufacture, then materials available, etc., other thickness arrangements, such as, for example thinner or thicker (such as, ⅛ inch, ⅜ inch, etc.), varying thickness, etc., may suffice.

Figure 4A:
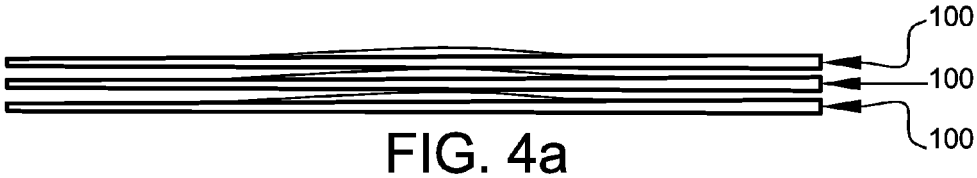
FIG. 4*a* shows a side elevational view of several stacked scraping tool systems of FIG. 1.

FIG. 4*a* shows a side elevational view of several stacked scraping tool systems 100.

Figure 5:
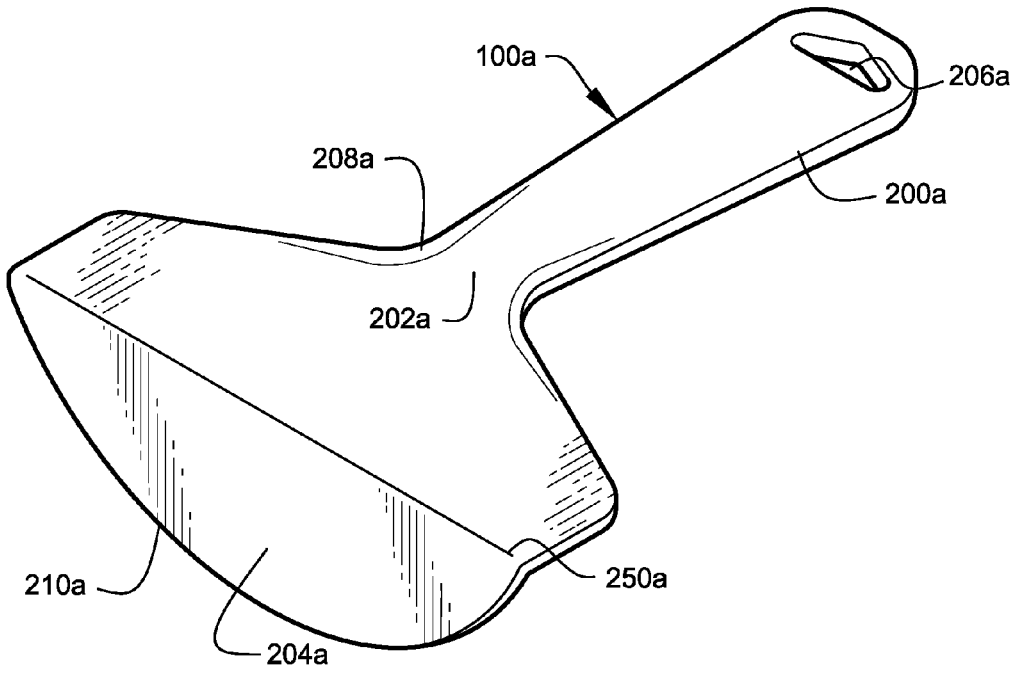
FIG. 5 shows perspective view of a scraping tool system according to an alternate preferred embodiment of the present invention.

FIG. 5 shows a perspective view of scraping tool system 100*a* according to an alternate preferred embodiment of the present invention. Preferably, scraping tool system 100*a* comprises handle 200*a*, neck 202*a*, and blade 204*a*, as shown. Preferably, scraping tool system 100 is one monolithic piece, as shown (at least embodying herein wherein such scraping tool system consists essentially of one monolithic piece). Preferably, scraping tool system 100 is plastic. Upon reading the teachings of this specification, those with ordinary skill in the art will now understand that, under appropriate circumstances, considering such issues as user preference, cost of manufacture, then materials available, etc., other manufacturing methods and material arrangements, such as, for example, using materials other than plastic (such as, for example, metal, wood, carbon-fiber, using multiple different materials, etc.), stamping or punching, assembling pieces rather than casting entire scraping tool system as one monolithic piece, etc., may suffice.

Preferably, handle 200*a* is substantially flat, as shown (at least embodying herein substantially flat gripping means for gripping the scraping tool system). Preferably, blade 204*a* is substantially flat, as shown (at least embodying herein substantially flat scraping means for scraping material). Preferably, blade 204*a* comprises bend 250*a* and blade edge 210*a*, as shown. Upon reading the teachings of this specification, those with ordinary skill in the art will now understand that, under appropriate circumstances, considering such issues as user preference, cost of manufacture, then materials available, etc., other blade arrangements, such as, for example, blades with different shapes, blade edges lined with different material (such as, for example, resilient material, for example, rubber, etc.), etc., may suffice.

Preferably, bend 250*a* is about 90 degrees. Preferably, neck 202*a* comprises at least one neck reinforcer 208*a*, as shown. Preferably, neck reinforcer 208*a* strengthens and reinforces neck 202*a* to help resist bending and breaking. Preferably, neck reinforcer 208*a* comprises extra material thickness, preferably at least one ridge of extra thick material, as shown. Upon reading the teachings of this specification, those with ordinary skill in the art will now understand that, under appropriate circumstances, considering such issues as user preference, cost of manufacture, then materials available, etc., other neck arrangements, such as, for example, neck reinforcers comprising different materials (such as, for example, metal, etc.), neck reinforcer comprising thickening the entire neck cross-sectional thickness in addition to, or instead of, thickened ridges, etc., may suffice.

Preferably, handle 200*a* comprises hanger 206*a*, as shown. Preferably hanger 206*a* is located in handle 200*a*, as shown (at least embodying herein wherein such gripping means comprises hanging means for hanging the scraping tool system). Preferably hanger 206*a* comprises an aperture, as shown, which is preferably adapted to permit scraping tool system 100*a* to be hung from a nail (at least embodying herein wherein such hanging means comprises at least one aperture). Upon reading the teachings of this specification, those with ordinary skill in the art will now understand that, under appropriate circumstances, considering such issues as user preference, cost of manufacture, then materials available, etc., other hanger arrangements, such as, for example hooks, loops, etc., may suffice.

Figure 6:
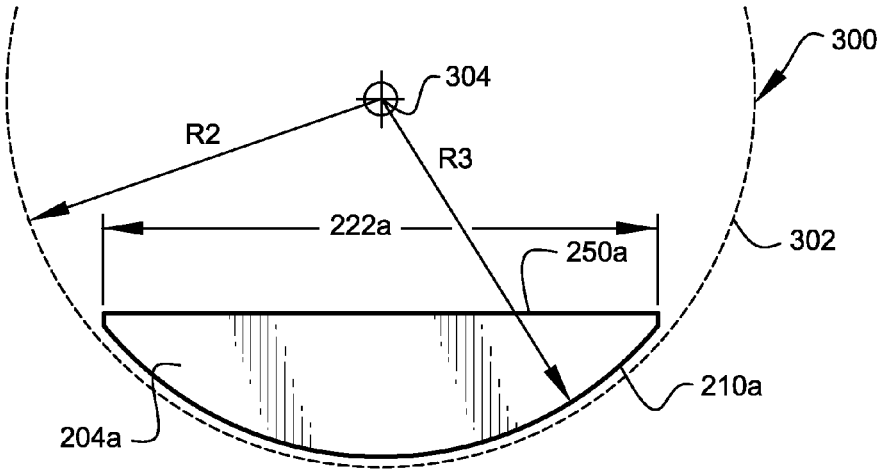
FIG. 6 shows a bottom plan view of the scraping tool system of FIG. 5, illustrating how the scraping tool system conforms to the bucket sidewall.

FIG. 6 shows a bottom plan view of the scraping tool system of FIG. 5, illustrating how the scraping tool system conforms to the bucket sidewall. Preferably, blade edge 210*a* has a substantially arcuate shape, as shown. Preferably, blade edge 210*a* conforms to bucket sidewall perimeter 302 of bucket 300, as shown. Preferably, blade edge 210*a* has a blade edge radius R3 which is about equal to bucket radius R2 (which is measured from bucket center 304 to bucket sidewall perimeter 302), as shown.

Following are preferred dimensions for a preferred embodiment of scraping tool system 100*a* for use in conjunction with a bucket 300 having a bucket radius R2 of about four inches (such as, for example, a standard five-gallon bucket). Preferably scraping tool system 100 has a blade edge radius R3, as shown, of about four inches. Preferably scraping tool system 100*a* has a blade width 222*a*, as shown, of about 6½ inches. Preferably, scraping tool system 100 has a first length 226*a*, as shown, of about 6½ inches, and a blade length 228*a*, as shown, of about 1½ inches. Preferably, scraping tool system 100*a* fits inside bucket 300, as shown.

Following are preferred dimensions for a preferred embodiment of scraping tool system 100*a* for use in conjunction with a bucket 300 having a bucket radius R2 of about five inches (such as, for example, a standard five-gallon bucket). Preferably scraping tool system 100 has a blade edge radius R3, as shown, of about five inches. Preferably scraping tool system 100*a* has a blade width 222*a*, as shown, of about 7½ inches. Preferably, scraping tool system 100 has a first length 226*a*, as shown, of about 7½ inches, and a blade length 228*a*, as shown, of about 2 inches. Preferably, scraping tool system 100*a* fits inside bucket 300, as shown.

Upon reading the teachings of this specification, those with ordinary skill in the art will now understand that, under appropriate circumstances, considering such issues as user preference, cost of manufacture, etc., other dimensional arrangements, such as, for example larger or smaller dimensions, different radii (such as, 3 inches, 6 inches, etc.), larger or smaller blade widths, etc., may suffice.

Figure 7:
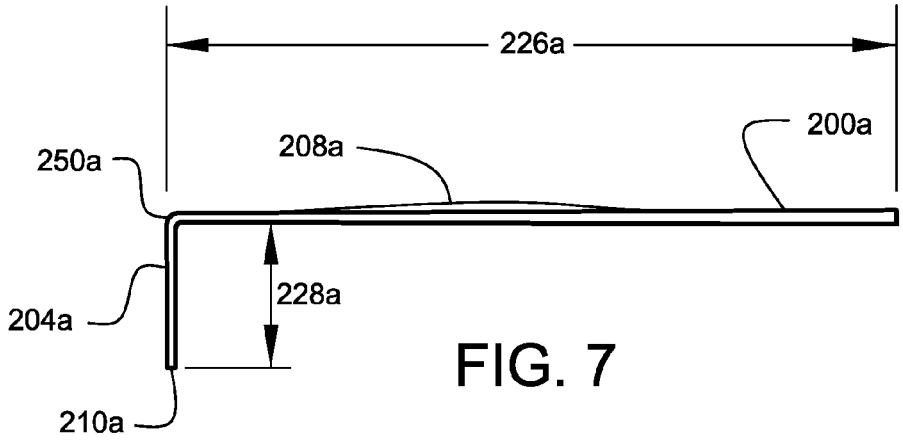
FIG. 7 shows a side elevational view of the scraping tool system of FIG. 5.

FIG. 7 shows a side elevational view of the scraping tool system of FIG. 5. Preferably, handle 200*a* and blade 204*a* are substantially perpendicular, as shown (at least embodying herein wherein said at least one substantially flat scraper is substantially perpendicular to said at least one substantially flat handle). Upon reading the teachings of this specification, those with ordinary skill in the art will now understand that, under appropriate circumstances, considering such issues as user preference, cost of manufacture, etc., other angular arrangements, such as, for example angles other than substantially perpendicular (such as, 60 degrees, 45 degrees, 120 degrees, 225 degrees, etc.), may suffice.

Figure 7A:
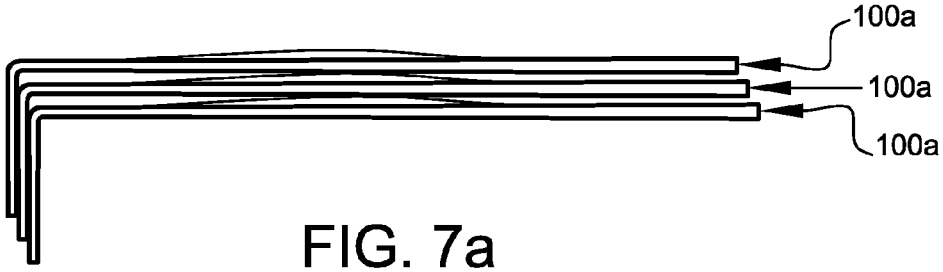
FIG. 7*a* shows a side elevational view of several stacked scraping tool systems of FIG. 5.

FIG. 7*a* shows a side elevational view of several stacked scraping tool systems 100*a*.

Although applicant has described applicant's preferred embodiments of this invention, it will be understood that the broadest scope of this invention includes modifications such as diverse shapes, sizes, and materials. Such scope is limited only by the below claims as read in connection with the above specification.

Further, many other advantages of applicant's invention will be apparent to those skilled in the art from the above descriptions and the below claims.

What is claimed is:

1. A scraping tool system, relating to scraping material from at least one bucket having at least one substantially round cylindrical internal sidewall, comprising:

a) at least one substantially flat gripper adapted to assist gripping said scraping tool system at at least one substantially flat portion of said scraping tool system; and b) at least one substantially flat scraper adapted to scrape the material from the at least one substantially round cylindrical internal sidewall with at least one substantially flat edge portion of said scraping tool system;

c) wherein said at least one substantially flat scraper comprises at least one substantially round arc;

d) wherein said at least one substantially flat scraper is substantially coplanar with said at least one substantially flat gripper; and e) wherein said scraping tool system lacks drainage holes that allow liquid to pass through.

2. The scraping tool system according to claim 1 wherein said scraping tool system consists essentially of one monolithic piece.

* * * * *